US005636903A

United States Patent [19]

Dickerson et al.

[11] Patent Number: 5,636,903

[45] Date of Patent: Jun. 10, 1997

[54] MINING SYSTEM FOR REMOVING OVERBURDEN

[75] Inventors: Alan W. Dickerson, Mt. Eliza; Viet K. L. Mai, Glen Waverely, both of Australia

[73] Assignee: BHP Australia Coal Limited, Australia

[21] Appl. No.: 305,675

[22] Filed: Sep. 14, 1994

[30] Foreign Application Priority Data

Sep. 14, 1993 [AU] Australia ..... PM1186

[51] Int. Cl.[6] ..... E02F 3/48; E02F 3/76

[52] U.S. Cl. ..... 299/36.1; 37/394; 172/829; 299/19

[58] Field of Search ..... 299/18, 19, 36; 37/394–398, 903; 172/799.5, 811, 829

[56] References Cited

U.S. PATENT DOCUMENTS

| | | | |
|---|---|---|---|
| 1,684,147 | 9/1928 | Roberts | 37/195 |
| 1,999,775 | 4/1935 | Neil | 37/400 |
| 2,013,276 | 9/1935 | Luce | 37/394 |
| 2,864,182 | 12/1958 | Russell | 37/394 |
| 5,250,199 | 10/1993 | Haag | 37/398 X |

FOREIGN PATENT DOCUMENTS

| | | | |
|---|---|---|---|
| 18277/29 | 2/1929 | Australia . | |
| 10041/88 | 7/1988 | Australia . | |
| 63540/86 | 8/1988 | Australia . | |
| 34502/89 | 11/1989 | Australia . | |
| 47322/93 | 3/1994 | Australia . | |
| 569610 | 1/1933 | Germany . | |
| 845330 | 7/1952 | Germany . | |
| 941362 | 3/1956 | Germany . | |
| 690182 | 10/1979 | U.S.S.R. | 299/19 |
| 16054 | of 1908 | United Kingdom | 37/398 |
| 1578006 | 10/1980 | United Kingdom . | |

OTHER PUBLICATIONS

*Mining Congress Journal* "Optimization of Dragline Operation", Morley et al, Jun. 1979.

Sauerman Tower Excavators Brochure (no publication date).

Patent Abstracts of Soviet Union, 1289–989–A, (Kuznt Opencast) 15 Feb. 1987 PAN–87–275959/39, SAN–N87–206633.

"An Introduction to Mining", L.J. Thomas, Published by Hicks, Smith & Sons, Sydney 1973, ISBN 0 45401730 8 and 0 454 01890 8. See pp. 128 & 129.

Patent Abstracts of Soviet Union, 994–733–A, (Kuzbass Poly) 7 Feb. 1983 PAN–84–274353/44, SAN–N84–204575.

Patent Abstracts of Soviet Union, 1097–793–A, (OSIPOV E D) 15 Jun. 1984 PAN–85–029983/05, SAN–N85–022098.

*Primary Examiner*—David J. Bagnell

*Attorney, Agent, or Firm*—Larson and Taylor

[57] ABSTRACT

A mining system for removing overburden from a valuable mineral or coal deposit from a pit (9) is disclosed. The mining system comprises a dragline (600) for removing overburden from a high wall side (3) of the pit (9) to produce a properly formed high wall face. The mining system further comprises a cross-pit transport assembly which comprises a cross-pit vehicle (13) for dislodging and transporting overburden that is located between the high wall side (3) and a low wall side (7) of the pit (9) towards the low wall side (7).

19 Claims, 14 Drawing Sheets

FIG. 3(g)
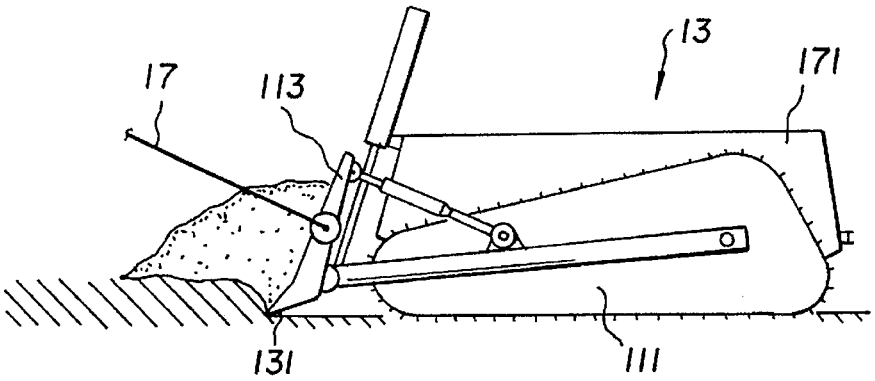
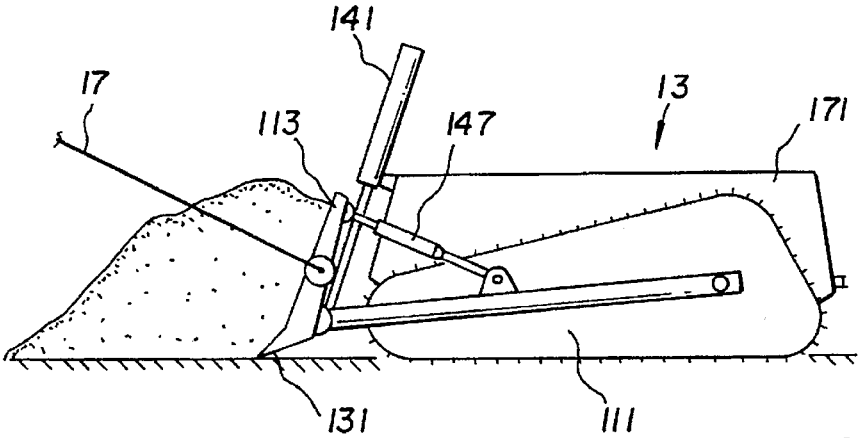
FIG. 3(h)
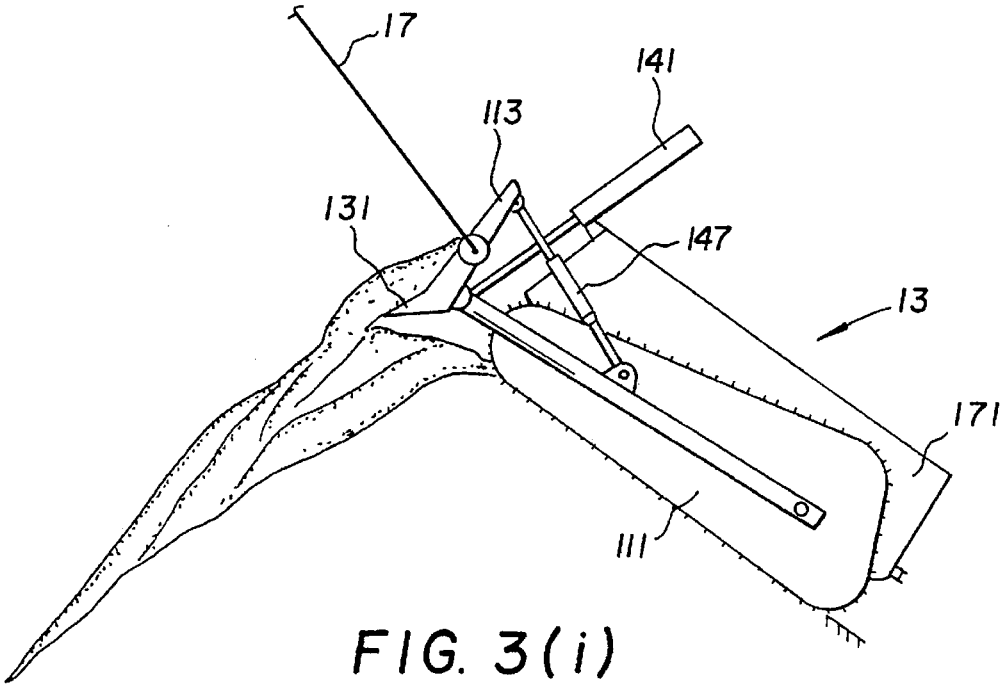
FIG. 3(i)

MINING SYSTEM FOR REMOVING OVERBURDEN

The present invention relates to a system and a method for removing overburden from a valuable mineral deposit such as a coal seam.

In strip type open cut coal mines such as those in the Bowen Basin of Queensland and other regions of the world, draglines are widely used and are a very cost effective means of removing the overburden above seams of coal for depths up to about 50 meters. As mining progresses to greater depths, the cost of removing the overburden from above the coal increases quickly because the distance over which much of the overburden has to be moved is greater than can be achieved with a single sequence of the dragline operation. Consequently, increasing amounts of the overburden must be excavated and placed in one position by the dragline and then, after repositioning of the dragline, the material is re-excavated and placed into a second position. As the depth of the coal seam increases, increasing amounts of the overburden must be double handled and sometimes even triple handled by the dragline before it is in its final position in the mined-out section of the mine. The cost of removing overburden with draglines increases rapidly as the depth of the coal increases from about 50 to about 65 m and for most draglines the economically feasible mining depth does not exceed about 60 m.

Two mining systems that are commonly used to supplement draglines and allow economic recovery of deep coal seams by open cut mining are excavator-loader plus truck systems and motorised tractor-scraper systems. Both these systems suffer the disadvantage of being relatively high cost systems and these costs severely limit the depth to which open cut coal mining can continue. A major reason for the high cost of these systems is that both involve long transport distances for the overburden material because neither trucks nor tractor-scrapers can negotiate the steep slopes that would be encountered in moving the overburden material by the shortest route which is directly across the pit. Actual transport distances can be 3 to 20 times the direct across-the-pit transport distance.

A range of cable pulled devices and apparatus have been proposed for excavating coal overburden and moving it directly across a pit to a final position on a low wall side of the pit, e.g. Australian patent specification AU-B-63540/86 (Beatty). All of these devices suffer from a problem of being unable to cut and to load correctly in the region of a high wall face to form the high wall face with a sufficiently steep incline as is required for continuing optimum blasting of the high wall side with explosives in subsequent strips.

An object of the present invention is to provide a mining system and a method for removing overburden which alleviates the disadvantages of the known and proposed mining systems discussed in the preceding paragraphs.

According to the present invention there is provided a mining system for removing overburden from a valuable mineral or coal deposit from a pit comprising, in combination:

(a) a dragline for removing overburden from a high wall side of the pit to produce a properly formed high wall face; and (b) a cross-pit transport assembly comprising a cross-pit vehicle for dislodging and transporting overburden that is located between the high wall side and a low wall side of the pit towards the low wall side.

The term "properly formed high wall face" is understood to mean herein a high wall face that is consistent with cost effective drilling and blasting practices. Usually, such a high wall face is one which has a steep incline, typically, at least 60° from the horizontal.

The term "vehicle" is understood herein to include, but is not limited to, wheeled or track mounted or skid mounted vehicles having bowls or buckets for carrying overburden and wheeled or track mounted or skid mounted dozers having dozer blades for displacing overburden.

It is preferred that the cross-pit transport assembly comprises:

(a) a first anchoring point movable along the low wall side of the pit;

(b) a cable connected to the cross-pit vehicle and to the low wall side anchoring point; and (c) a first winch assembly for winding the cable to pull the cross-pit vehicle forwards towards the low wall side anchoring point.

The term "anchoring point" is understood herein to cover any suitable means of reacting against the forces required to move the cross-pit vehicle.

It is preferred particularly that the cross-pit transport assembly comprises:

(a) two spaced-apart first anchoring points movable along the low wall side of the pit;

(b) two cables, one cable connected to the cross-pit vehicle and to one first anchoring point, and the other cable connected to the cross-pit vehicle and to the other first anchoring point; and (c) a first winch assembly associated with each of the cables for winding the associated cable to pull the cross-pit vehicle forward towards the low wall side.

By way of example, the anchoring point may be a dozer, with or without anchoring spikes at the blade end and the back end and/or a converted dragline and/or a converted electric rope shovel and/or a purpose designed machine.

The term "cable" is understood herein to describe any suitable form of cable, rope, or wire.

It is preferred that the cross-pit transport assembly further comprises;

(a) a second anchoring point movable along the high wall side of the pit;

(b) a cable connected to the cross-pit vehicle and to the high wall side anchoring point; and (c) a second winch assembly for winding the cable to pull the cross-pit vehicle rearwards towards the high wall side anchoring point.

It is preferred that the first winch assembly be mounted on the low wall side anchoring point.

It is preferred that the second winch assembly be mounted on the high wall side anchoring point.

It is preferred particularly that the low wall side and the high wall side anchoring points be crawler mounted.

In one arrangement, it is preferred that the cross-pit vehicle comprises, a cutting blade for dislodging overburden as the cross-pit vehicle is being pulled towards the low wall side, and a bowl or bucket for receiving and carrying the dislodged overburden transferred into the bowl or bucket due to the forward motion of the cross-pit vehicle, with or without loading-assist mechanisms.

It is preferred more particularly that the cutting blade be movable between a loading position at which the cutting blade extends into and displaces the overburden into the bowl or bucket and a transporting position at which the cutting blade is clear of the overburden.

It is preferred that the cross-pit vehicle comprises a means to controllably adjust the loading position of the cutting blade.

In an alternative arrangement to that described above, it is preferred that the cross-pit vehicle comprises, a dozer blade mounted at a forward end of the cross-pit vehicle for displacing overburden as the cross-pit vehicle is being pulled towards the low wall side.

With such an arrangement it is preferred that the cross-pit vehicle comprises a means to controllably adjust the position of the dozer blade.

It is preferred that the cross-pit vehicle be one of a wheeled vehicle, a track-mounted vehicle, and a skid-mounted vehicle.

It is preferred that the cross-pit vehicle comprises an engine means to drive the cross-pit vehicle from the low wall side towards the high wall side.

It is also preferred that the engine means provide power for the adjustment means for the cutting blade.

It is noted that in a particularly preferred arrangement the engine means is operable to drive the cross-pit vehicle to assist the movement of the cross-vehicle from the high wall side towards the low-wall side.

According to the present invention there is also provided a method of removing overburden from a valuable mineral deposit comprising the following series of steps carried out successively along the length of a pit to progressively remove overburden along the length of the pit:

(a) forming a pile of overburden on the pit floor from a section of a high wall side of the mine;

(b) forming a bench for supporting a dragline on the overburden between the high wall side and a low wall side of the pit;

(c) locating the dragline on the bench and operating the dragline to remove a desired amount of overburden to produce a properly formed high wall face; and (d) after completing step (c) and moving the dragline to another location, operating a cross-pit transport assembly to remove part or all of the remainder of the overburden overlying the valuable mineral deposit in that section of the mine.

It is preferred that the method step (a) comprises forming the pile of overburden by blasting a section of the high wall side of the mine.

Step (c) will hereinafter be referred to as the "initial cut" and may comprise operating the dragline in any suitable methods.

The present invention is described further by way of example with reference to the accompanying drawings in which:

FIG. 3(*b*) is a top plan view of the cross-pit vehicle shown in FIG. 3(*a*);

FIG. 3(*c*) is a side elevation of another preferred embodiment of a cross-pit vehicle of a mining system in accordance with the present invention;

Figure 1:
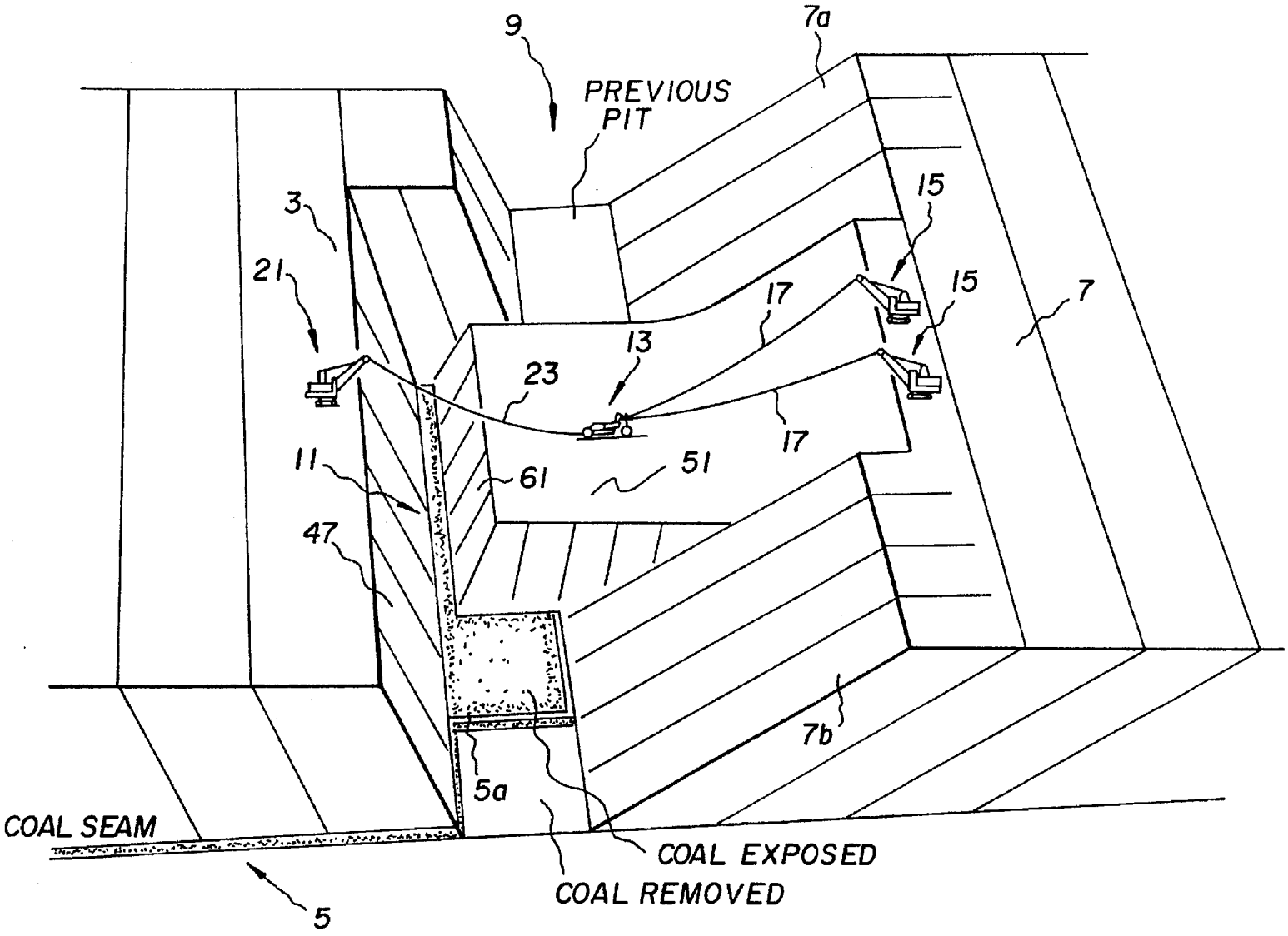
FIG. 1 is a schematic view of an open cut mine during a stage of one preferred embodiment of the method of removing overburden in accordance with the present invention.

FIGS. 3(*d*), 3(*e*) and 3(*f*) are side elevations of another preferred embodiment of a cross-pit vehicle of a mining system in accordance with the present invention;

FIGS. 3(*g*), 3(*h*), and 3(*i*) are side elevations of another preferred embodiment of a cross-pit vehicle of a mining system in accordance with the present invention;

FIGS. 4 to 9 are cross-sectional sketches of the open cut mine shown in FIG. 1 illustrating a typical pit cross-section and the main stages of removing overburden in accordance with one preferred embodiment of the method of the present invention; and FIGS. 10 to 16 are cross-sectional sketches illustrating the main stages of removing overburden in accordance with another preferred embodiment of the method of the present invention.

FIG. 1 provides a general overview of an open cut coal mine which is being mined by one preferred embodiment of the mining system of the present invention in accordance with a preferred embodiment of the method of the present invention.

With reference to FIG. 1, the open cut mine comprises a high wall side 3 which covers a seam 5 of coal, a low wall side 7 formed from overburden which has been moved to sequentially expose strips of coal, a mined out (previous) pit 9, and a newly exposed section of coal 5*a*.

In general terms, in the preferred embodiment of the method of the invention, a section of the high wall side 3 is collapsed, typically by blasting with explosives, onto the coal to be exposed and into the mined out pit 9 and forms a pile of overburden, and this overburden is subsequently moved with machines further across the pit 9 towards the low wall side 7 (and as a consequence advances an original low wall face 7*a*), thereby exposing an area 5*a* of the coal seam 5. The exposed coal seam 5*a* can then be mined by any suitable means.

The preferred embodiment of the mining system of the present invention for carrying out the foregoing method comprises, in combination:

(a) a dragline (not shown) for forming an initial cut 11 (FIG. 1.) in a pile of overburden produced, by way of example, by blasting a section of the high wall side 3; and (b) a cross-pit transport assembly for moving the overburden towards the low wall side 7 to expose the area 5*a* of the coal seam and to advance the original low wall face 7*a* to form a new low wall face 7*b*.

The dragline and the cross-pit transport assembly may be of any suitable configuration.

Figure 2:
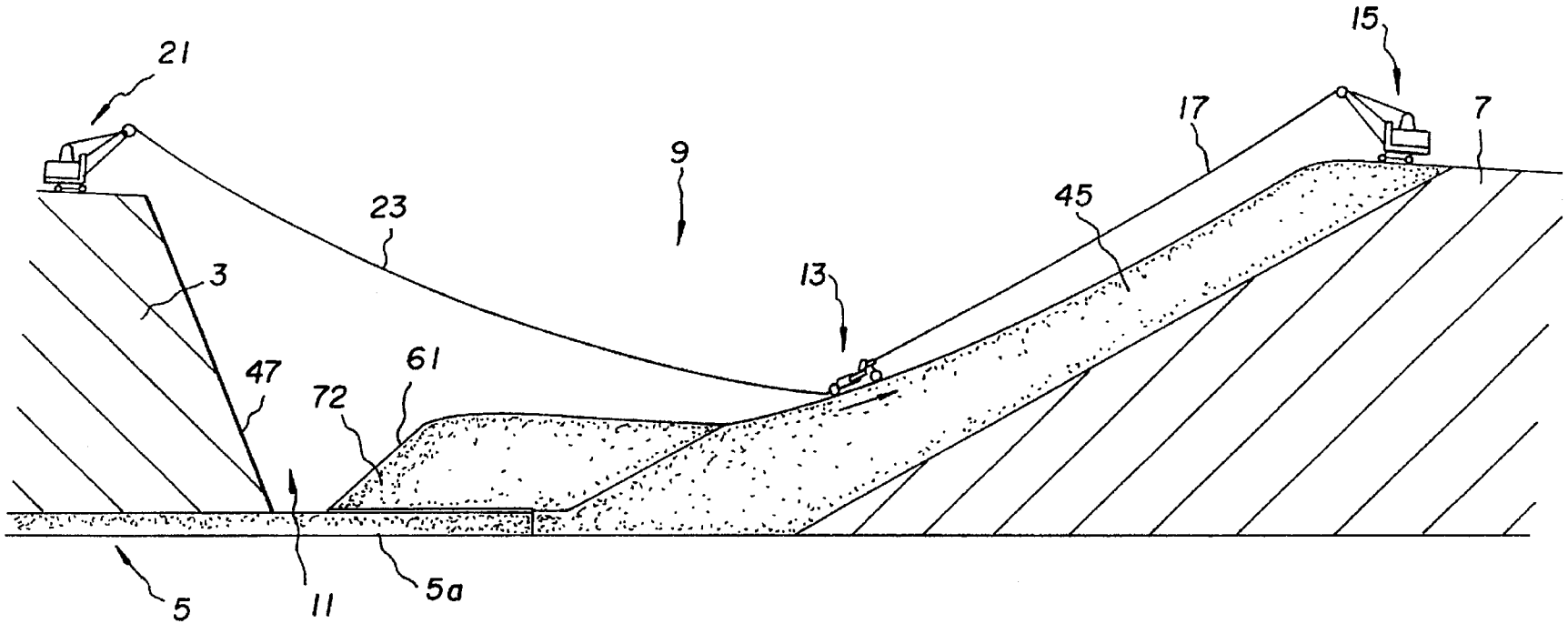
FIG. 2 is a cross-sectional sketch of the open cut mine shown in FIG. 1 illustrating a typical pit cross-section during the stage of the preferred embodiment of the method of removing overburden in accordance with the present invention illustrated in FIG. 1.
Figure 3A:
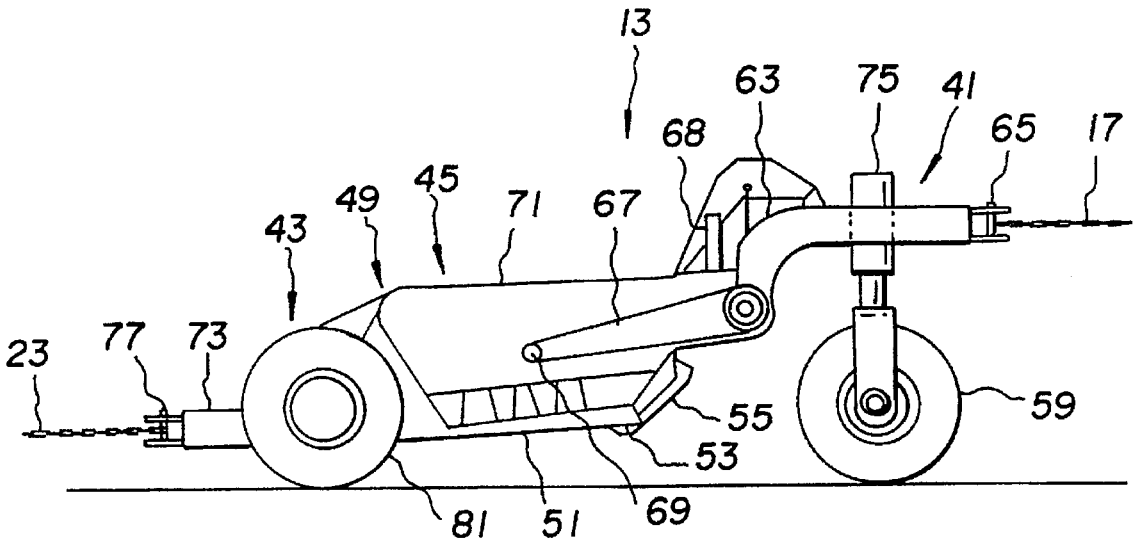
FIG. 3(*a*) is a side elevation of one preferred embodiment of a cross-pit vehicle of a preferred embodiment of a mining system in accordance with the present invention.
Figure 3B:
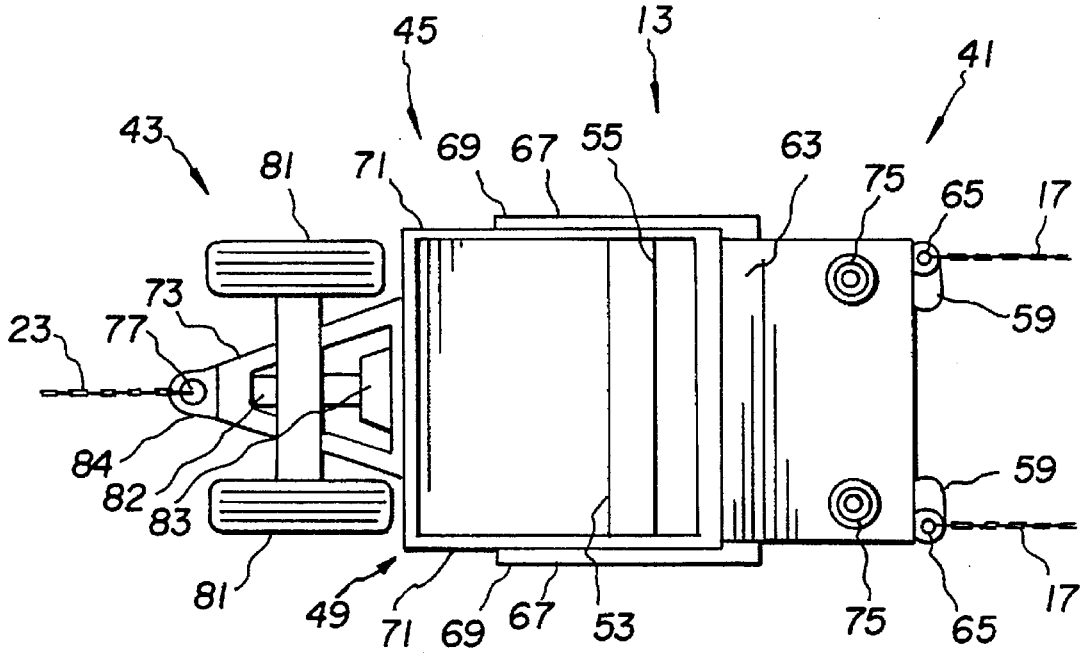
Figure 3C:
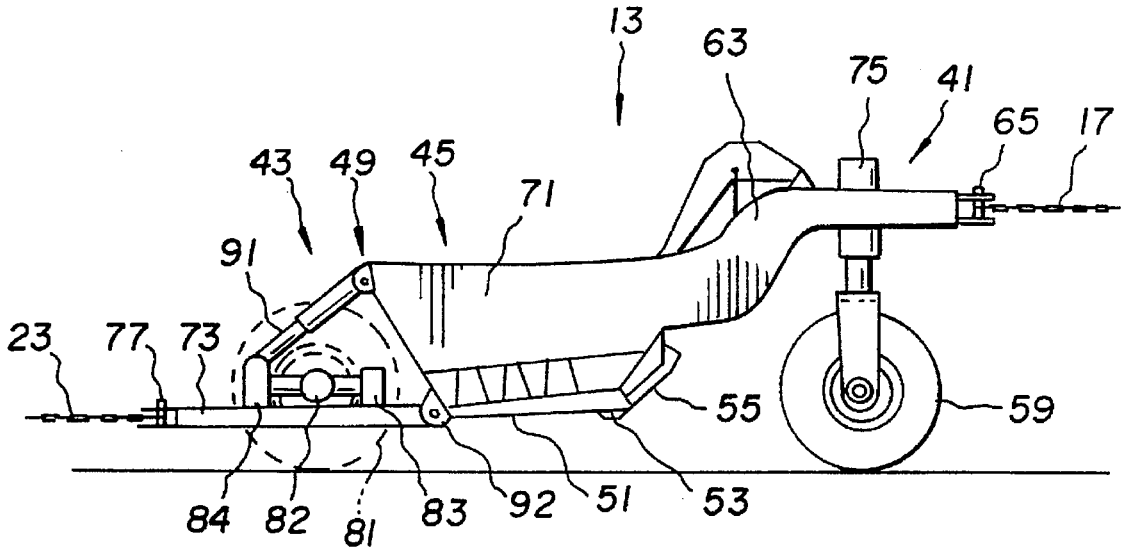
Figure 3D:
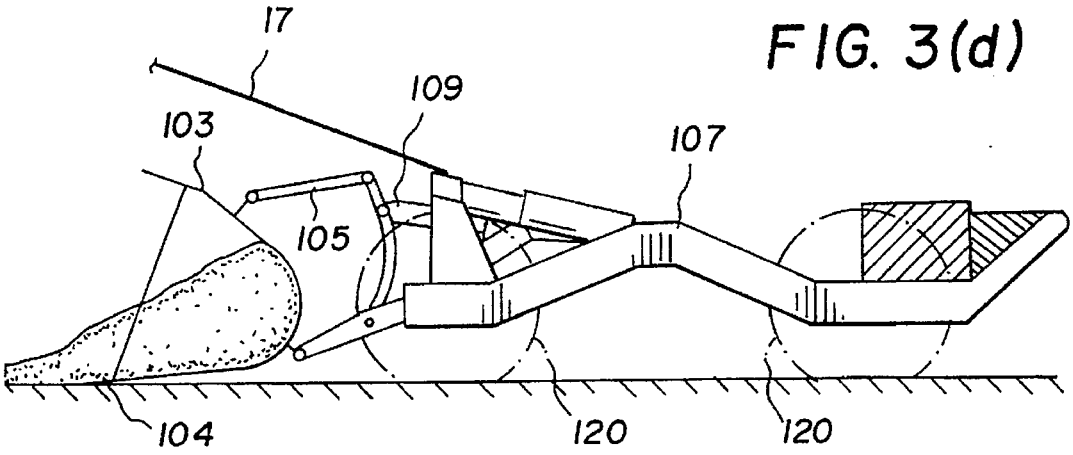
Figure 3E:
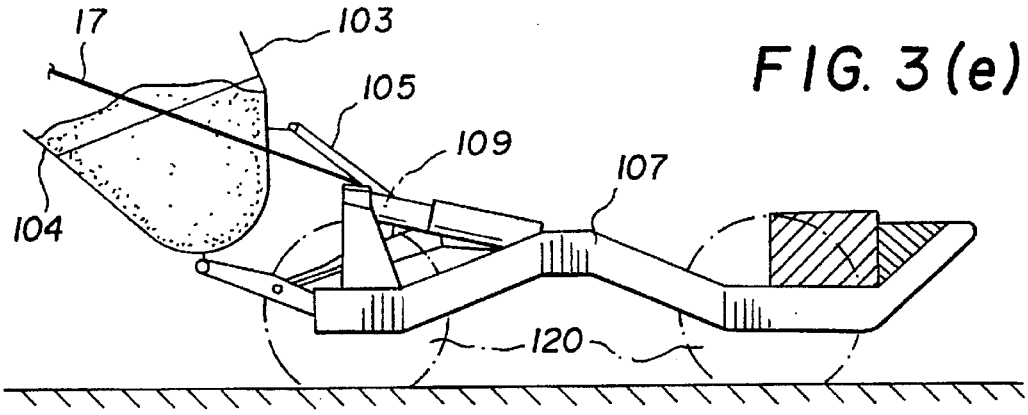
Figure 3F:
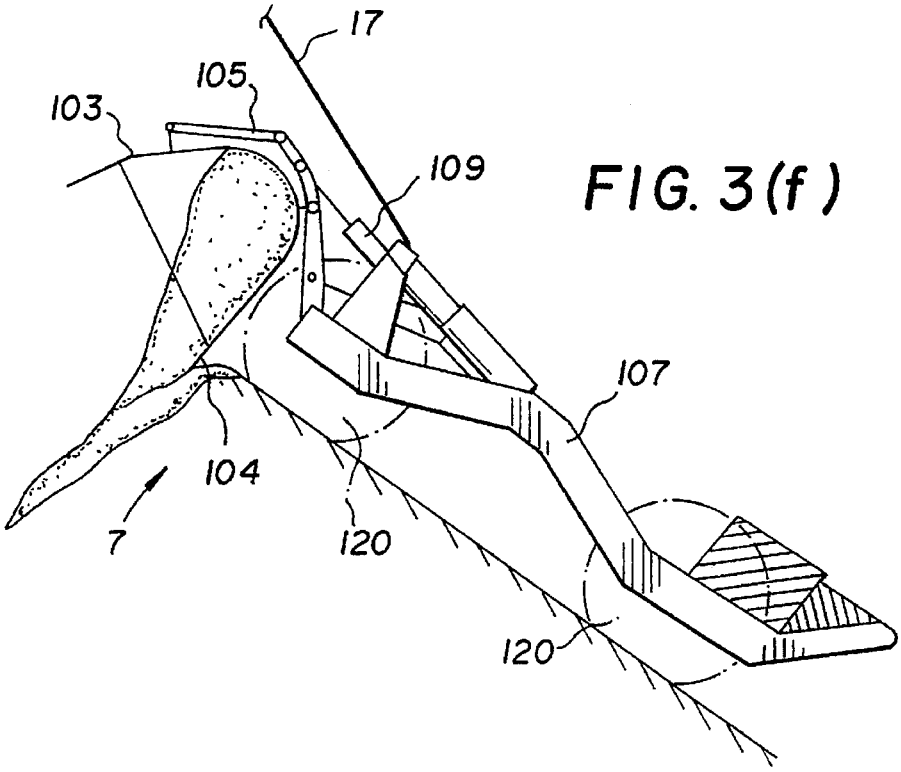

With reference to FIGS. 1 and 2, in one preferred embodiment of the mining system of the invention, the cross-pit transport assembly comprises, a cross-pit transporting vehicle 13, two crawler mounted winch assemblies 15 on the low wall side 7, each separately connected by cables 17 to opposite sides of a forward end of the cross-pit transporting vehicle 13, and a crawler mounted winch assembly 21 on the high wall side 3 connected by a cable 23 to the rearward end of the cross-pit transporting vehicle 13.

With reference to FIGS. 3(*a*) and 3(*b*), one preferred embodiment of the cross-pit transporting vehicle 13 comprises, a forward wheel assembly 41, a rear wheel assembly 43, and a bowl 45 for receiving and carrying overburden positioned between and coupled to the forward and the rear wheel assemblies 41, 43.

The bowl 45 comprises side walls 71, a rear wall 49, a floor 51 which terminates at a forward end in a cutting edge 53, and a door assembly 55 which is movable between a closed position (shown in FIG. 3(*a*) preventing access to and egress from the bowl 45 through the forward end thereof and an open position (not shown) allowing access to and egress from the bowl 45 through the forward end.

The forward wheel assembly 41 comprises two ground engaging wheels 59 each of which is connected to a support frame 63 by means of a suspension system in the from of a sliding piston/cylinder arrangement 75. The support frame 63 comprises forward hitching points 65 for the cables 17 and arms 67 which extend along both side walls 71 of the bowl 45. The free ends 69 of the side arms 67 are pivotally connected to the side walls 71 of the bowl 45. The arrangement of the forward wheel assembly 41 allows clearance for large rocks to be gathered up by the cutting edge 53 and the bowl 45 and by varying the volume of oil in each of the two cylinders it also allows control of the cross-wise angle of the cutting edge 53 and bowl 45 relative to the cross-slope of the ground being traversed by the front wheels 59.

The rear wheel assembly 43 comprises two ground engaging wheels 81 and crossed beam member 82 which is mounted via trunnion bearings 83 and 84 in a support frame 73 which is connected to the bowl 45. The support frame 73 comprises a rearward hitching point 77 for the cable 23. The arrangements of the rear wheel assembly 43 provides limited freedom for side ways articulation of the rear wheel assembly 43 relative to the bowl 45 of the cross-pit transporting vehicle 13 in order to assist with controlling the cross-wise angle of the cutting edge 53 and the bowl 45 relative to the ground traversed by the front wheels 59.

The cross-pit transporting vehicle 13 further comprises hydraulic piston/cylinder assemblies 68 (not fully shown) mounted on the support frame 63 of the forward wheel assembly 41 and connected to the forward end of the bowl 45. The piston/cylinder assemblies 68 control the position of the bowl 45, and more particularly the cutting edge 53 of the floor 51 of the bowl 45, relative to the overburden. Specifically, the combined effect of the piston/cylinder assemblies 68 and the pivotal connection between the side arms 67 and the bowl 45 is to allow the cutting edge 53 on the bowl 45 to be movable between:

(a) a loading position in which the cutting edge 53 extends into and, on forward movement of the cross-pit transporting vehicle 13, displaces the overburden into the bowl 45; and (b) a transporting position (FIG. 3 (*a*) in which the bowl 45 is clear of the overburden.

It is noted that the piston/cylinder assemblies 68 enable the loading position of the cutting edge 53 to be adjusted as may be required depending on the terrain in the pit 9.

In the loading position, as the cross-pit transporting vehicle 13 is moved in a forward direction towards the low wall side 7, the cutting edge 53 cuts into and displaces overburden from the pit floor into the bowl 45. When the bowl 45 is full the piston/cylinder assemblies 68 are actuated to lift the bowl 45 and thereby the cutting edge 53 clear of the overburden and the door assembly 55 is closed to retain the overburden in the bowl 45.

Another preferred embodiment of the cross-pit transporting vehicle 13 is shown in FIG. 3(*c*).

This embodiment is similar to that of FIGS. 3(*a*) and 3(*b*) except that the height of the rear end of the bowl 45 is adjustable relative to the rear wheel assembly 43 and that the separate side arms 67 and the associated adjusting cylinder 68 are eliminated.

With the cross-pit transporting vehicle 13 shown in FIG. 3(*c*) the position of the cutting edge 53 relative to the ground surface is adjusted by controlling the piston/cylinder arrangements 75 at the front of the cross-pit transporting vehicle 13 and the piston/cylinder arrangement 91 which controls the height of the rear of the cross-pit transporting vehicle 13 relative to the rear wheel assembly 43. In this connection, the support frame 73 is hingedly attached to the rear of the bowl 45 at pivot 92. The advantage of this arrangement is to enable a much stronger and durable connection between the cables 17 and the cutting edge 53. It also allows the bowl 45 to be in a position where the floor 51 of the bowl 45 is more nearly horizontal when the cutting edge 53 is in the operative position. This reduces the difficulty in making the cut overburden slide up into the bowl 45.

An alternative method of achieving the same function as provided by the arrangement of FIG. 3(*c*) could be to support each of the rear wheels 81 of the cross-pit transporting vehicle 13 of FIGS. 3(*a*) and 3(*b*) independently in the same way as shown for the front wheels 59, that is by a form of the sliding piston/cylinder arrangement 75.

Another preferred embodiment of the cross-pit transporting vehicle 13 is shown in FIGS. 3(*d*), 3(*e*), and 3(*f*).

With reference to the figures, the bowl 45 of the embodiments shown in FIG. 3(*a*) to 3(*c*) is replaced by a bucket 103 having a cutting edge 104 which is supported by an assembly 105 of link arms to the forward end of a wheel-mounted loader transporter 107.

The cross-pit transporting vehicle 13 further comprises a piston/cylinder assembly 109 which is operable to move the bucket 103 between:

(a) a loading position shown in FIG. 3(*d*) in which the cutting edge 104 of the bucket 103 extends into and, on forward movement of the cross-pit transporting vehicle 13 towards the low wall side 7 (i.e. movement to the left as shown in FIG. 3(*d*), displaces overburden into the bucket 103, (b) a carrying position shown in FIG. 3(*e*) in which the bucket 103 is clear of the underlying overburden and at an angle which provides good retention of the load in the bucket 103; and (c) an unloading position shown in FIG. 3(*f*) in which the bucket 103 is tilted to discharge the overburden from the bucket 103 on the low wall side 7 of the pit 9.

The loader transporter 107 includes a diesel power pack (not shown) which is operable (i) to supply power to a hydraulic power pack (not shown) that operates the piston/cylinder assembly 109 and (ii) to drive the wheels 120 of the cross-pit vehicle 13 to return the cross-pit transporting vehicle 13 from the low wall side 7 to the high wall side 3 of the pit 9 after the bucket 103 has been emptied. As a consequence, it is only necessary to connect the cross-pit transporting vehicle 13 by means of the cables 17 to the crawler mounted winch assemblies 15 on the low wall side 7, and thus anchoring point(s) 21 on the high wall side 3 and the cable(s) 23 are not required. It is noted that the diesel power pack may also assist the loader 107 in forward movement towards the low wall side 7.

Another preferred embodiment of the cross-pit transporting vehicle 13 is shown in FIGS. 3(*g*), 3(*h*), and 3(*i*).

With reference to the figures, the cross-pit vehicle 13 is a modified motor-driven dozer 171 mounted on tracks 111 with a dozer blade 113.

The dozer blade 113 comprises a fore/aft tilt control means 147 and a sideways tilt control means (not shown) and, optionally, side plates (not shown) to minimise side flow of overburden.

The cross-pit vehicle 13 further comprises a piston/cylinder assembly 141 which is operable to move the dozer blade 113 between;

(a) a loading position shown in FIG. 3(*g*) in which the cutting edge 131 of the dozer blade 113 extends into the overburden and, on forward movement of the cross-pit vehicle 13 towards the low wall side 7 (i.e. movement to the left as shown in FIG. 3(*g*)), displaces and moves overburden forward;

(b) subsequent loading positions at which the dozer blade 113 is raised progressively to reduce the depth of penetration into the overburden;

(c) a transporting position shown in FIG. 3(*h*) where the penetration into the overburden is just sufficient to maintain the desired load on the dozer blade 113; and (d) and unloading position shown in FIG. 3(*i*).

The main stages of one preferred embodiment of the method of the present invention are described hereinafter with reference to FIGS. 4 to 9.

Figure 4:
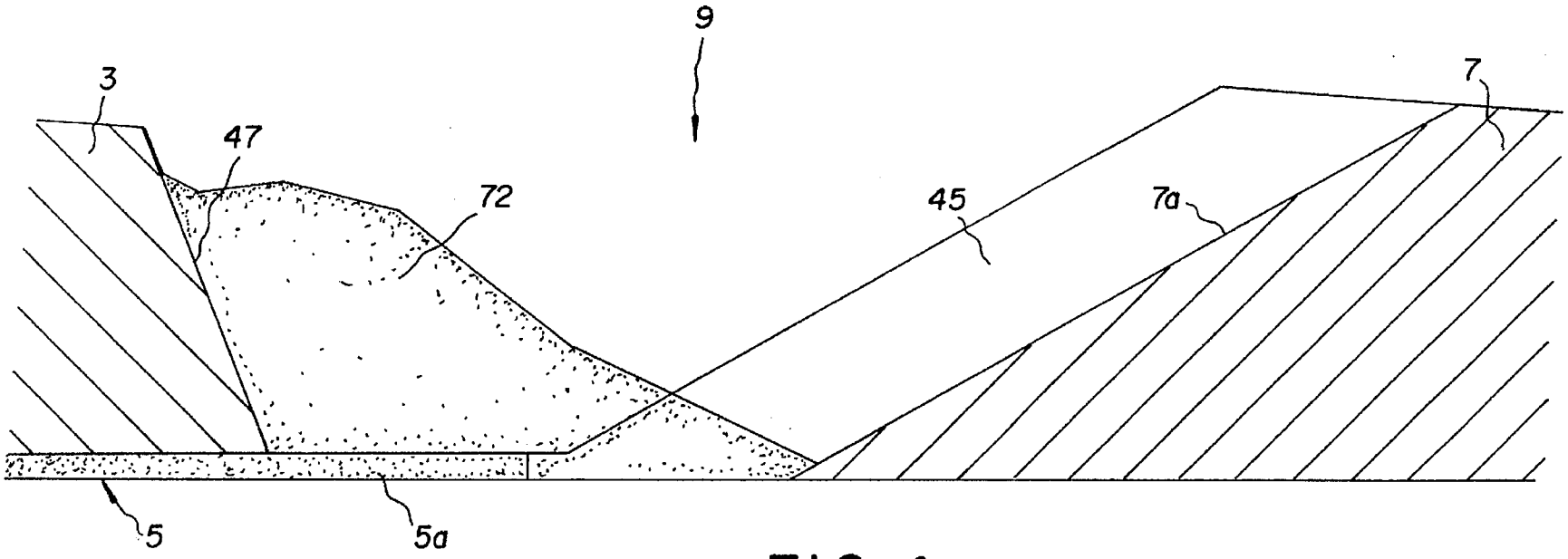

With reference initially to FIG. 4, as discussed previously, the objective of the method is to uncover an area 5*a* of the coal seam 5 by blasting a section of the high wall side 3 and moving the resultant pile 73 of overburden from the high wall side 3 of the pit 9 to the low wall side 7 of the pit 9, and thereby expose the area 5*a* of the coal seam 5. The area 45 defined by the dotted line in the figure denotes the profile of the extended low wall side 7 after moving the pile 73 of overburden. The line 47 in the figure denotes the face of the high wall side 3 which is exposed after the pile 73 of overburden has been moved.

Figure 5:
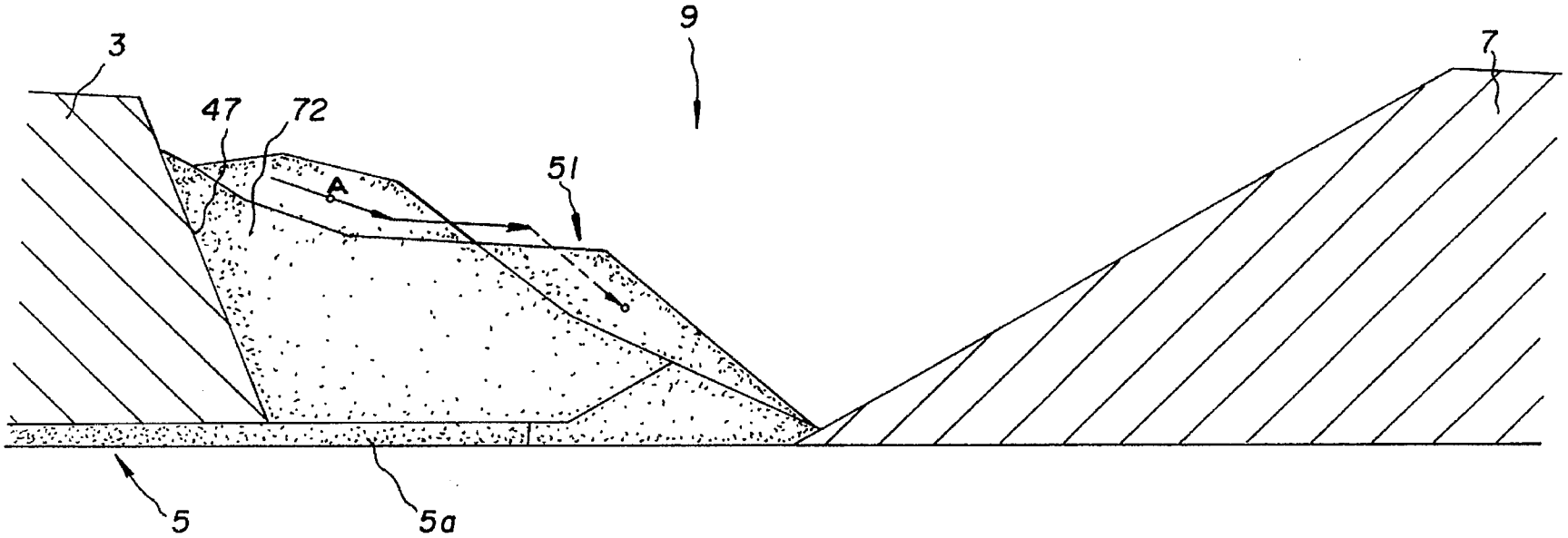

With reference to FIG. 5, the first stage of the method comprises forming a stable bench 51 for supporting a dragline (not shown). This operation may be performed by operating the assembly including the cross-pit transporting vehicle 13 and/or by a dozer and/or by a suitable dragline.

Figure 6:
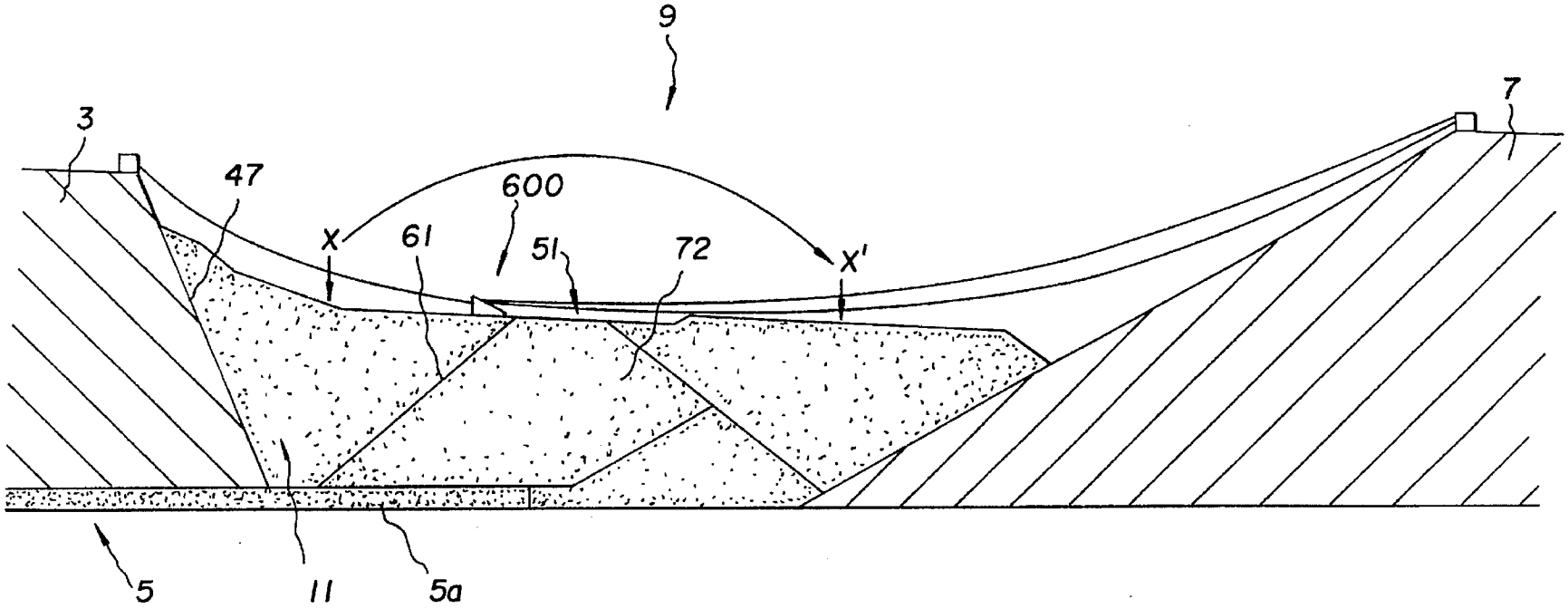

With reference to FIG. 6, the second stage of the method comprises positioning a dragline 600 on the bench 51 and operating the dragline 600 to move the overburden in the area X to the area X' to form an initial cut 11 in the overburden between the bench 51 and the high wall face 47. A particular advantage of the use of the dragline 600 is that it is well suited to form a steep and stable exposed face 47 to the high wall side 3.

Figure 7:
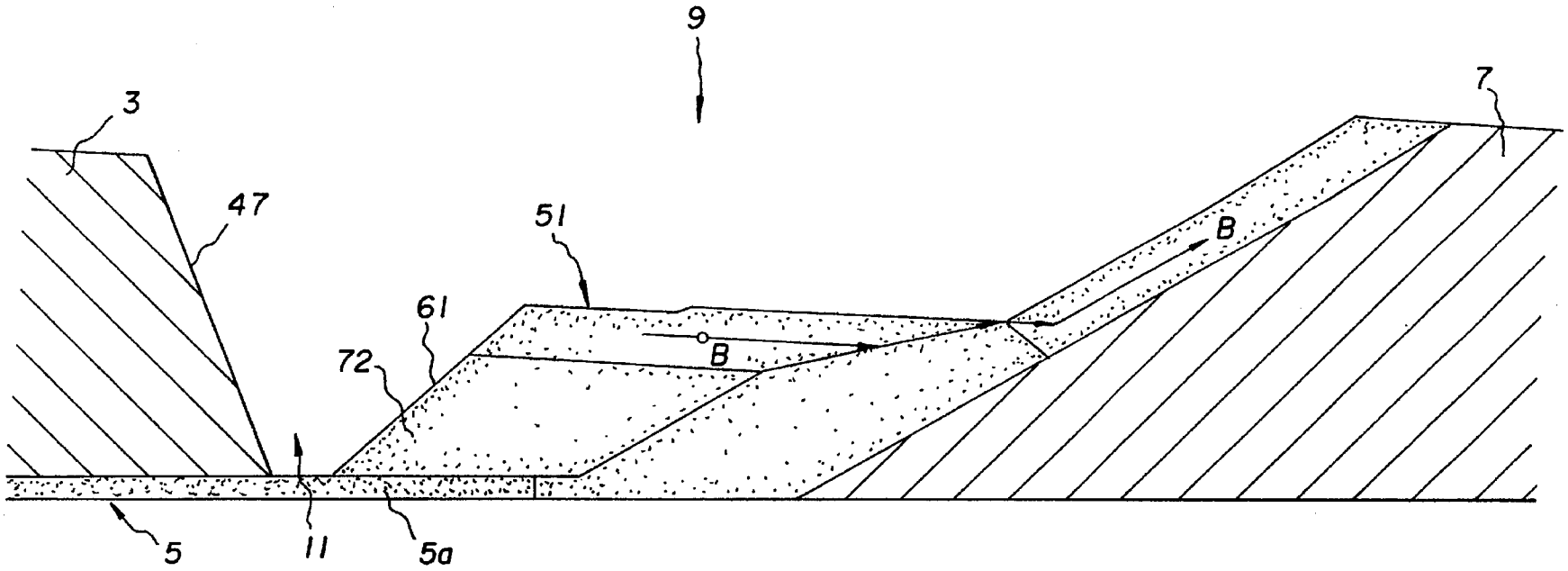
Figure 8:
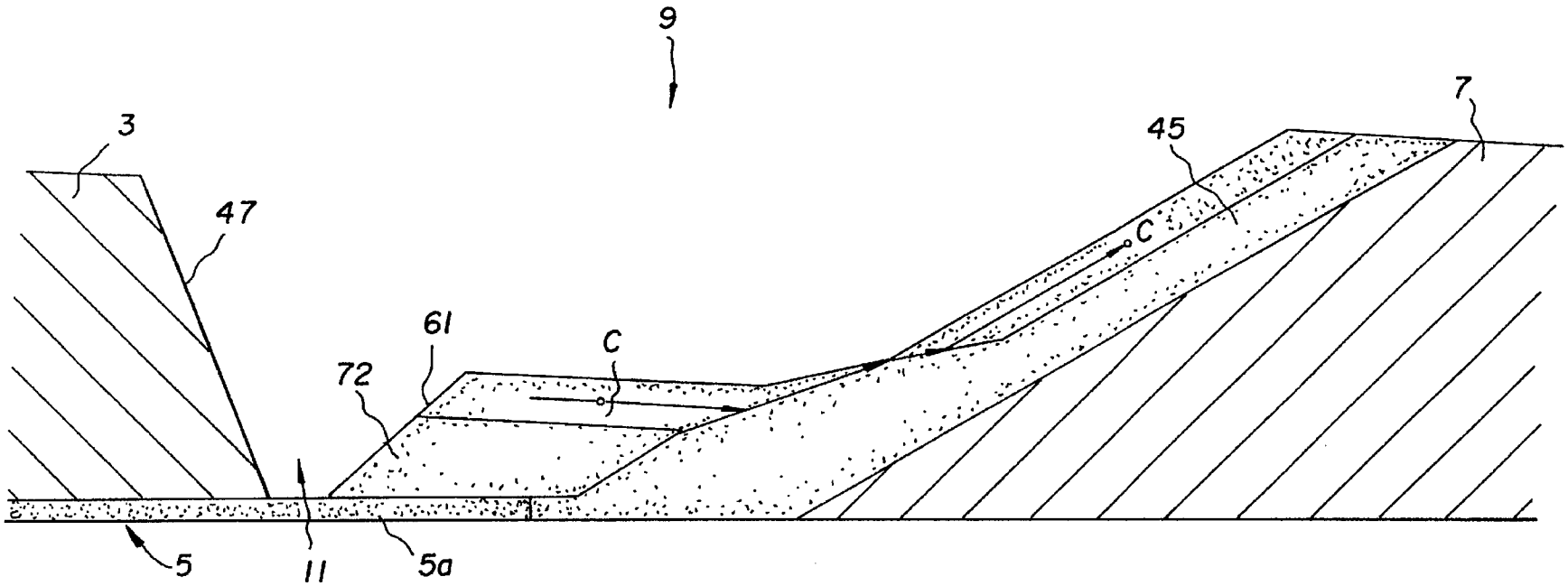
Figure 9:
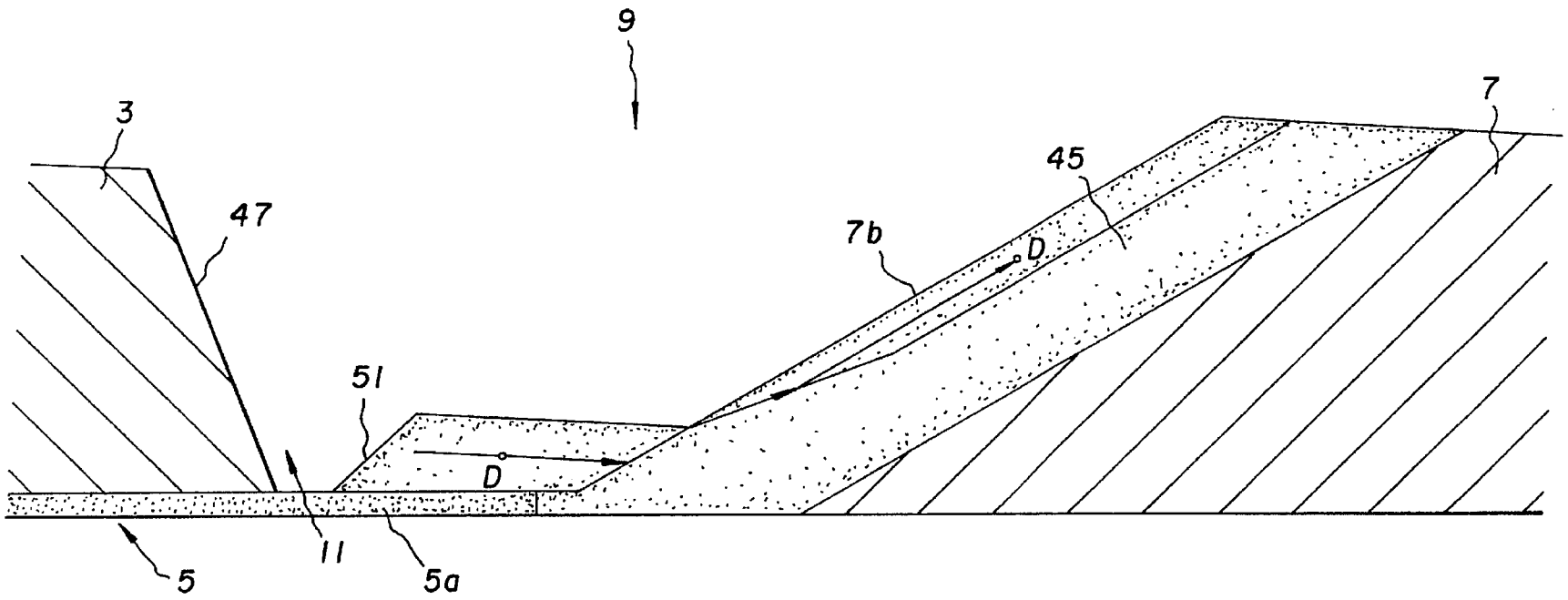
Figure 10:
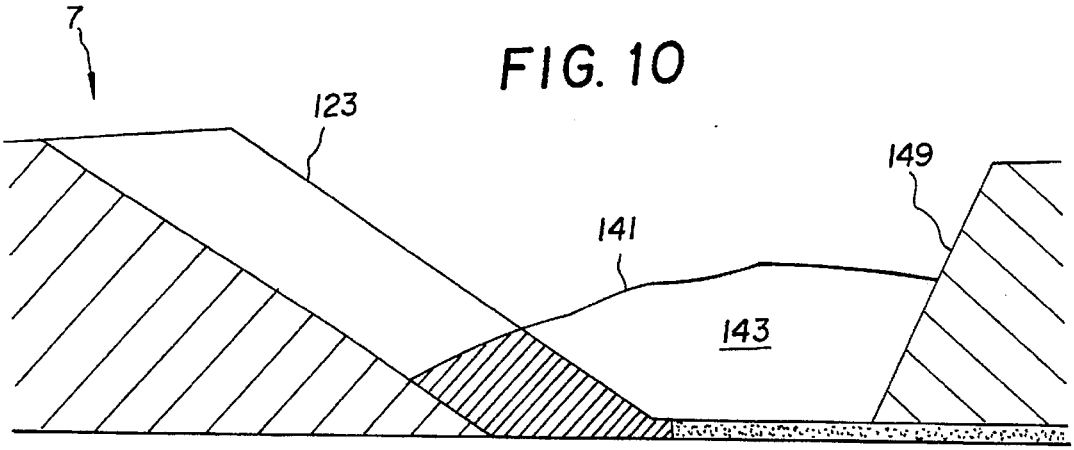

With reference to FIGS. 7 to 9, the third stage of the method comprises operating the cross-pit transport assembly 13 to progressively carry overburden form the areas B, C, and D to the areas B', C', and D', respectively, thereby exposing the area 5*a* of the coal seam 5 and forming a stable extension of the low wall side 7. In this connection, it is noted that as a consequence of forming the initial cut 11 there is an exposed face 61 of the overburden against which the cutting edge 53 of the cross-pit transporting vehicle 13 can operate effectively.

The uncovered area 5*a* of the coal seam 5 may be mined by any suitable means. By way of particular example, the uncovered area 5*a* may be mined b the cross-pit transport assembly.

The main stages of another preferred embodiment of the method of the present invention are described with reference to FIGS. 10 to 16.

With reference to the figures, the line 141 denotes the original blast profile, the dotted line 123 denotes the profile of the extended low wall side 7 after moving the pile 143 of overburden from the original blast profile, and the line 149 denotes the face of the high wall side 3 which is exposed after moving the pile 143 of overburden.

Figure 11:
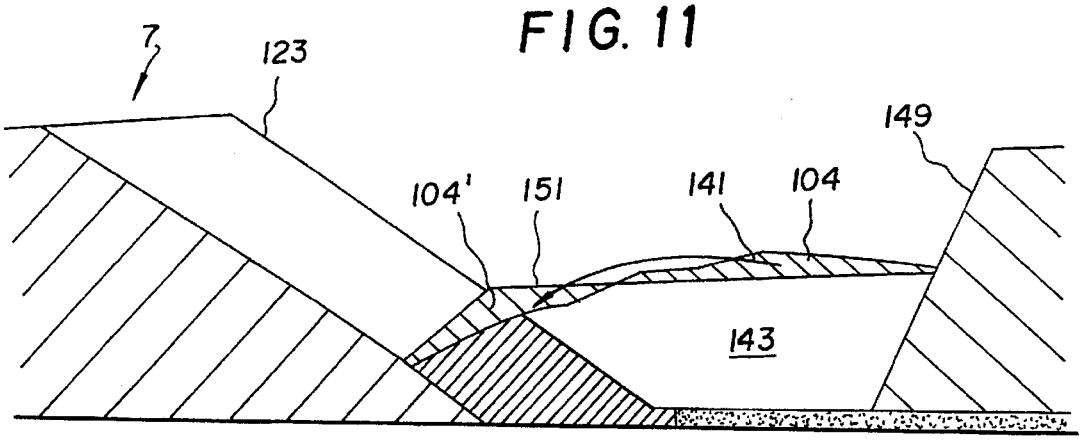

With reference to FIG. 11, the first stage of the method comprises forming a stable bench 151 for supporting a dragline (not shown). This operation involves moving the overburden in the area 104 to the area 104'.

Figure 12:
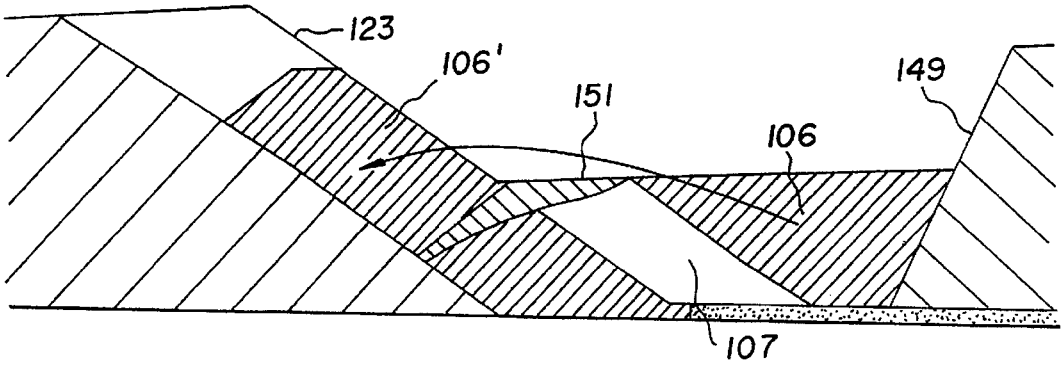
Figure 13:
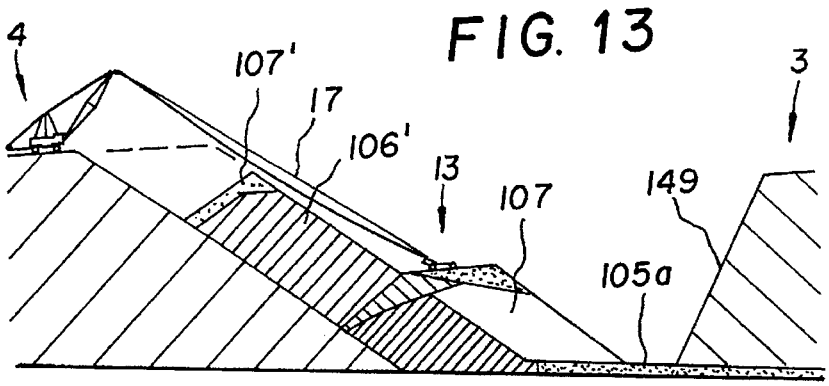
Figure 14:
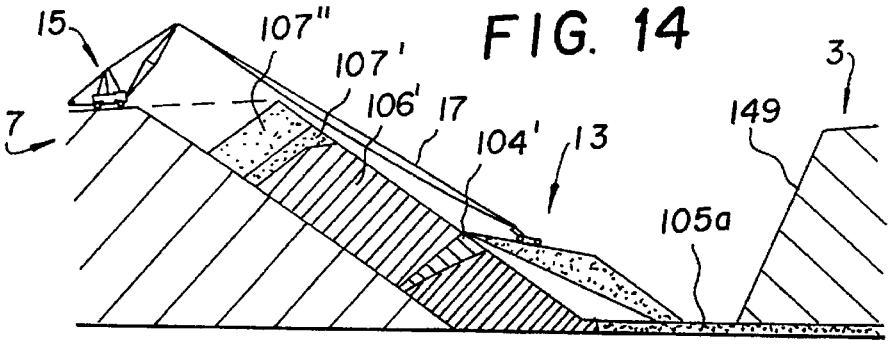
Figure 15:
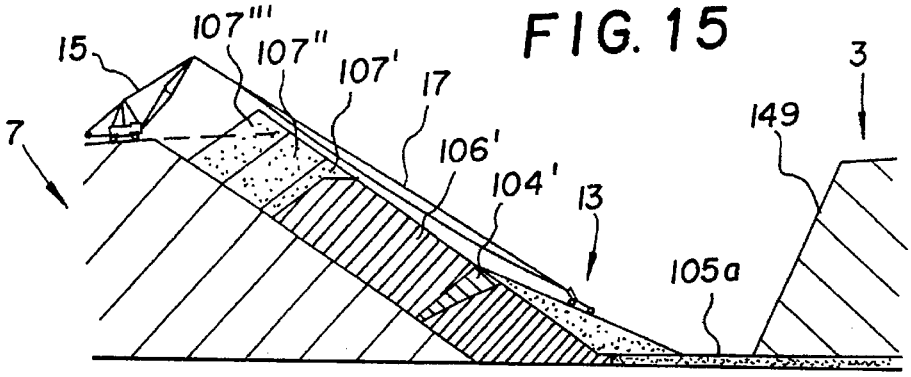

With reference to FIG. 12, the second stage of the method comprises positioning a dragline (not shown) on the bench 151 and operating the dragline to move the overburden in the area 106 to the area 106 ' to thereby form the lower part of the extended low wall side 7 and to open up the initial cut 11 (FIG. 13) in the overburden and to establish the high wall face 149.

Figure 16:
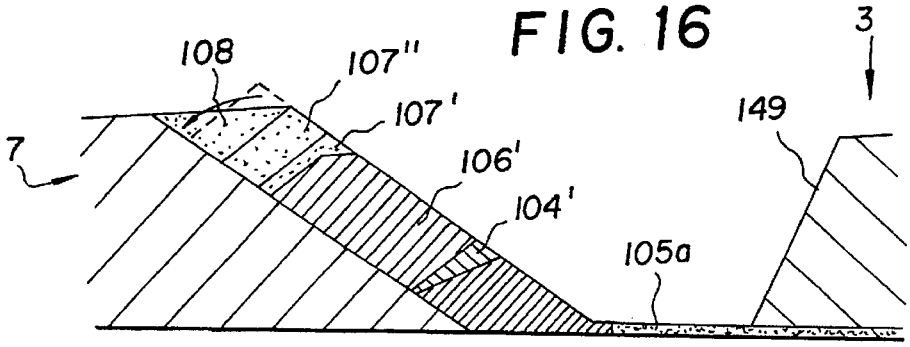

With reference to FIGS. 13 to 16, the third stage of the method comprises operating the cross-pit assembly 13 to progressively carry overburden from the area marked 107 to the areas 107', 107", and 107'" and levelling the area 107'" by any suitable means to form the area 108 in FIG. 16. The full profile of the extended low wall side 7 is thus completed.

After the completion of the third stage the uncovered area 105*a* of coal may be mined by an suitable means.

The preferred embodiments of the mining system and the method of the present invention described above have a number of advantages over know mining systems and methods, some of which have been discussed in the foregoing description.

One general advantage not mentioned previously is that the preferred embodiments use the dragline and the cross-pit transport assembly for the purposes for which they were principally intended and thereby optimises the performance of these devices.

In addition, another important advantage is that the operation of the cross-pit vehicle 13 can be controlled from a position remote from the cross-pit vehicle 13, for example on the low wall side 7. This is particularly important from the viewpoint of safety. In addition, it is important from the view point of optimising the operation of the cross-pit vehicle 13 for given terrain conditions.

Many modifications may be made to the preferred embodiment of the mining system and method of the present invention without departing from the spirit and scope of the present invention.

We claim:

1. A mining system for removing overburden from a valuable mineral or coal deposit from a pit comprising, in combination:

(a) a dragline for removing overburden from a high wall side of the pit to produce a properly formed high wall face; and (b) a cross-pit transport assembly comprising a cross-pit vehicle for transporting overburden dislodged by the dragline, towards a low wall side of the pit to expose the valuable mineral or coal deposit, the cross-pit transport assembly comprising, a first anchoring point movable along the low wall side of the pit, a cable connected to the cross-pit vehicle and to the low wall side anchoring point, and a first winch assembly for winding the cable to pull the cross-pit vehicle forward towards the low wall side anchoring point, and the cross-pit vehicle comprising a dozer blade mounted at a forward end of the cross-pit vehicle for displacing overburden as the cross-pit vehicle is being pulled towards the low wall side.

2. The system defined in claim 1, wherein the cross-pit transport assembly comprises:

(a) two spaced-apart first anchoring points movable along the low wall side of the pit;

(b) two cables, one cable connected to the cross-pit vehicle and to one first anchoring point, and the other cable connected to the cross-pit vehicle and to the other first anchoring point; and (c) a first winch assembly associated with each of the cables for winding the associated cable to pull the cross-pit vehicle forward towards the low wall side.

3. The system defined in claim 2, further comprising:

(a) a second anchoring point movable along the high wall side of the pit;

(b) a cable connected to the cross-pit vehicle and to the high wall side anchoring point; and (c) a second winch assembly for winding the cable to pull the cross-pit vehicle rearwards towards the high wall side anchoring point.

4. The system defined in claim 3, wherein the second winch assembly is mounted in the high wall side anchoring point.

5. The system defined in claim 4, wherein the low wall side and/or the high wall side anchoring points are crawler mounted.

6. The system defined in claim 4, wherein the low wall side and the high wall side anchoring points are selected from the group comprising dozers, converted draglines, and converted electric rope shovels.

7. The system defined in claim 2, wherein each first winch assembly is mounted on the low wall side anchoring point.

8. The system defined in claim 1, wherein the cross-pit vehicle comprises a means to adjust the height transverse tilt, and fore/aft tilt of the dozer blade.

9. The system defined in claim 8, wherein the cross-pit vehicle comprises an engine means to drive the cross-pit vehicle from the low wall side towards the high wall side.

10. The system defined in claim 1, wherein the cross-pit vehicle is any one of a wheeled vehicle, a track-mounted vehicle, and a skid-mounted vehicle.

11. A mining system for removing overburden from a valuable mineral or coal deposit from a pit comprising, in combination:

(a) a dragline for removing overburden from a high wall side of the pit to produce a properly formed high wall face; and (b) a cross-pit transport assembly comprising a cross-pit vehicle for dislodging and transporting overburden that is located between the high wall side and a low wall side of the pit towards the low wall side, the cross-pit transport assembly comprising, two spaced-apart first anchoring points movable along the low wall side of the pit, two cables connected to the cross-pit vehicle and the low wall side anchoring points, and a first winch assembly associated with each of the cables for winding the associated cable to pull the cross-pit vehicle forward towards the low wall side anchoring points, and the cross-pit vehicle comprising a dozer blade mounted at a forward end of the cross-pit vehicle for displacing overburden as the cross-pit vehicle is being pulled towards the low wall side.

12. The system defined in claim 11, further comprising:

(a) a second anchoring point movable along the high wall side of the pit;

(b) a cable connected to the cross-pit vehicle and to the high wall side anchoring point; and (c) a second winch assembly for winding the cable to pull the cross-pit vehicle rearwards towards the high wall side anchoring point.

13. The system defined in claim 11, wherein each first winch assembly is mounted on the low wall side anchoring point.

14. The system defined in claim 11, wherein the second winch assembly is mounted on the high wall side anchoring point.

15. The system defined in claim 11, wherein the low wall side and/or the high wall side anchoring points are crawler mounted.

16. The system defined in claim 11, wherein the low wall side and the high wall side anchoring points are selected from the group comprising dozers, converted draglines, and converted electric rope shovels.

17. A mining system for removing overburden from a valuable mineral or coal deposit from a pit comprising, in combination:

(a) a dragline for removing overburden from a high wall side of the pit to produce a properly formed high wall face; and (b) a cross-pit transport assembly comprising a cross-pit vehicle for dislodging and transporting overburden that is located between the high wall side and a low wall side of the pit towards the low wall side, the cross-pit transport assembly comprising, an anchoring point movable along the low wall side of the pit, a cable connected to the cross-pit vehicle and to the low wall side anchoring point, and a winch assembly for winding the cable to pull the cross-pit vehicle forward towards the low wall side anchoring point, and the cross-pit vehicle comprising a dozer blade mounted at a forward end of the cross-pit vehicle for displacing overburden as the cross-pit vehicle is being pulled towards the low wall side, and a means to adjust the height, transverse tilt, and fore/aft tilt of the dozer blade.

18. The system defined in claim 17, wherein the cross-pit vehicle comprises an engine means to drive the cross-pit vehicle from the low wall side towards the high wall side.

19. A mining system for removing overburden from a valuable mineral or coal deposit from a pit, said system comprising:

a cross-pit transport assembly comprising a cross-pit vehicle for dislodging and transporting overburden that is located between the high wall side and a low wall side of the pit towards the low wall side, the cross-pit transport assembly comprising, an anchoring point movable along the low wall side of the pit, a cable connected to the cross-pit vehicle and to the low wall side anchoring point, and a winch assembly for winding the cable to pull the cross-pit vehicle forward towards the low wall side anchoring point, and the cross-pit vehicle comprising a dozer blade mounted at a forward end of the cross-pit vehicle for displacing overburden as the cross-pit vehicle is being pulled towards the low wall side, and a means to adjust the height, transverse tilt, and fore/aft tilt of the dozer blade.

* * * * *